US005184593A

United States Patent [19]

Kobayashi

[11] Patent Number: 5,184,593

[45] Date of Patent: Feb. 9, 1993

[54] FLOW CONTROL VALVE

[75] Inventor: Masahiro Kobayashi, Obu, Japan

[73] Assignee: Aisan Kogyo Kabushiki Kaisha, Obu, Japan

[21] Appl. No.: 805,767

[22] Filed: Dec. 12, 1991

[30] Foreign Application Priority Data

Dec. 28, 1990 [JP] Japan ..... 2-408683

[51] Int. Cl.[5] ..... F02M 25/07

[52] U.S. Cl. ..... 123/571; 251/129.11

[58] Field of Search ..... 123/571; 251/129.11, 251/129.12

[56] References Cited

U.S. PATENT DOCUMENTS

| | | | |
|---|---|---|---|
| 4,064,851 | 12/1977 | Wessel | 123/571 |
| 4,473,056 | 9/1984 | Ishida et al. | 123/571 |
| 4,674,464 | 6/1987 | Akagi | 123/571 |
| 4,742,989 | 5/1988 | Akagi | 251/129.11 |
| 4,782,811 | 11/1988 | Hewette et al. | 123/571 |
| 4,961,413 | 10/1990 | Grey et al. | 123/571 |

*Primary Examiner*—Willis R. Wolfe

*Attorney, Agent, or Firm*—Nikaido, Marmelstein, Murray & Oram

[57] ABSTRACT

Herein disclosed is a flow control valve, in which a lift type valve member having a valve stem is disposed in a valve housing and in which a motor has an output shaft moving in an axial direction inside of a rotor through threaded portions. The valve member is moved in a closing direction through the valve stem when the output shaft moves in the projecting direction. A first retainer is attached to the leading end of the output shaft, and a coil spring for urging the output shaft in the projecting direction is sandwiched between the first retainer and the front portion of the motor. To the leading end of the valve stem, there is attached a second retainer which is connected to the first retainer through a valve closing coil spring for urging the valve stem in the closing direction. The former coil spring has its spring force set weaker than that of the latter valve closing coil spring.

15 Claims, 2 Drawing Sheets

FLOW CONTROL VALVE

BACKGROUND OF THE INVENTION (1) Field of the Invention

The present invention relates to a motor driven type flow control valve to be used for controlling the flow rate of a fluid and, more particularly, to a flow control valve to be applied to an exhaust gas recirculation valve for recirculating the exhaust gas of an internal combustion engine into the intake system (2) Description of the Related Art An exhaust gas recirculation valve for recirculating exhaust gas of an internal combustion engine into the intake system is exemplified by a system for controlling the exhaust gas flow through a passage in a valve housing by actuating a lift type valve member by a step motor. Such a system is described in Japanese Laid-Open Patent No. 76748/1986.

Such a recirculation valve is constructed by fixing the front portion of the step motor on the end portion of the valve housing, by a) projecting the valve step connected to the valve member in the valve housing into the motor housing, b) providing the step motor with an output shaft which can be moved only in an axial direction into the rotor through threaded portions, and c) connecting a coil spring for urging the valve member in a closing direction to the leading end of the valve stem. Thus, the recirculation valve is opened by pushing the leading end of the valve stem against the urging force of the coil spring with the output shaft of the motor.

However, a recirculation valve of this kind is deficient in that the output shaft of the step motor is liable to rock due to vibrations during running of the motor. The rocking is partly due to the output shaft being supported in the rotor only by the threaded portions, and partly because the leading end of the output shaft is apart from the valve stem when the valve is closed.

The coil spring used has a strong spring force to impart a predetermined sealing force to the valve member when this member is closed, such that the motor is required to move the valve member in a valve opening direction against the urging force of the coil spring. As a result, such a recirculation valve in the related art uses a relatively large-sized motor having a high torque such that it suffers due to increased power consumption.

SUMMARY OF THE INVENTION

The flow control valve of the present invention is constructed such that a lift type valve member having a valve stem is disposed in a valve housing such that a motor has an output shaft moving in an axial direction through threaded portions inside of a rotor. The valve member is moved in a valve closing direction through the valve stem when the output shaft moves in a projecting direction. A retainer is attached to the leading end of the output shaft, and a first coil spring for urging the output shaft in the projecting direction is sandwiched between the retainer and the front portion of the motor. To the leading end of the valve stem, there is attached a small retainer which is connected to the retainer through a second "valve closing" coil spring for urging the valve stem in the closing direction. The first coil spring has its spring force set weaker than that of the latter valve closing coil spring.

When the valve is to be opened from its closed state, the motor rotates the rotor in a direction to move the output shaft so that the output shaft is retracted. At this time, the first coil spring between the retainer and the front portion of the motor is compressed. However, since the first coil spring has a weak spring force and since the valve closing coil spring has its spring force acting to return the shaft at the beginning of the valve opening operation, the motor can open the valve with a low torque.

When closing the valve, on the other hand, the motor rotates the rotor in a direction to cause the output shaft to move in a projecting direction. Since, at this time, the spring force of the first coil spring is exerted in a direction to project the shaft, the motor can drive with a very weak torque. When the valve member abuts against the valve seat, the output shaft advances while compressing the valve closing coil spring, until the motor stops. In this state, the valve member is urged and closed by the valve closing coil spring which, having a relatively strong spring force, allows for a good seal between the valve member and seat.

An object of the present invention is to provide a motor driven type flow control valve which can retain a predetermined closing and sealing force during valve closing, and use a relatively low torque small-sized motor as has been described above.

BRIEF DESCRIPTION OF THE DRAWINGS

The above and other objects and the attendant advantages of the invention will become more readily apparent by reference to the following detailed description when considered in conjunction with the accompanying drawings wherein.

DESCRIPTION OF THE PREFERRED EMBODIMENT

Figure 1:
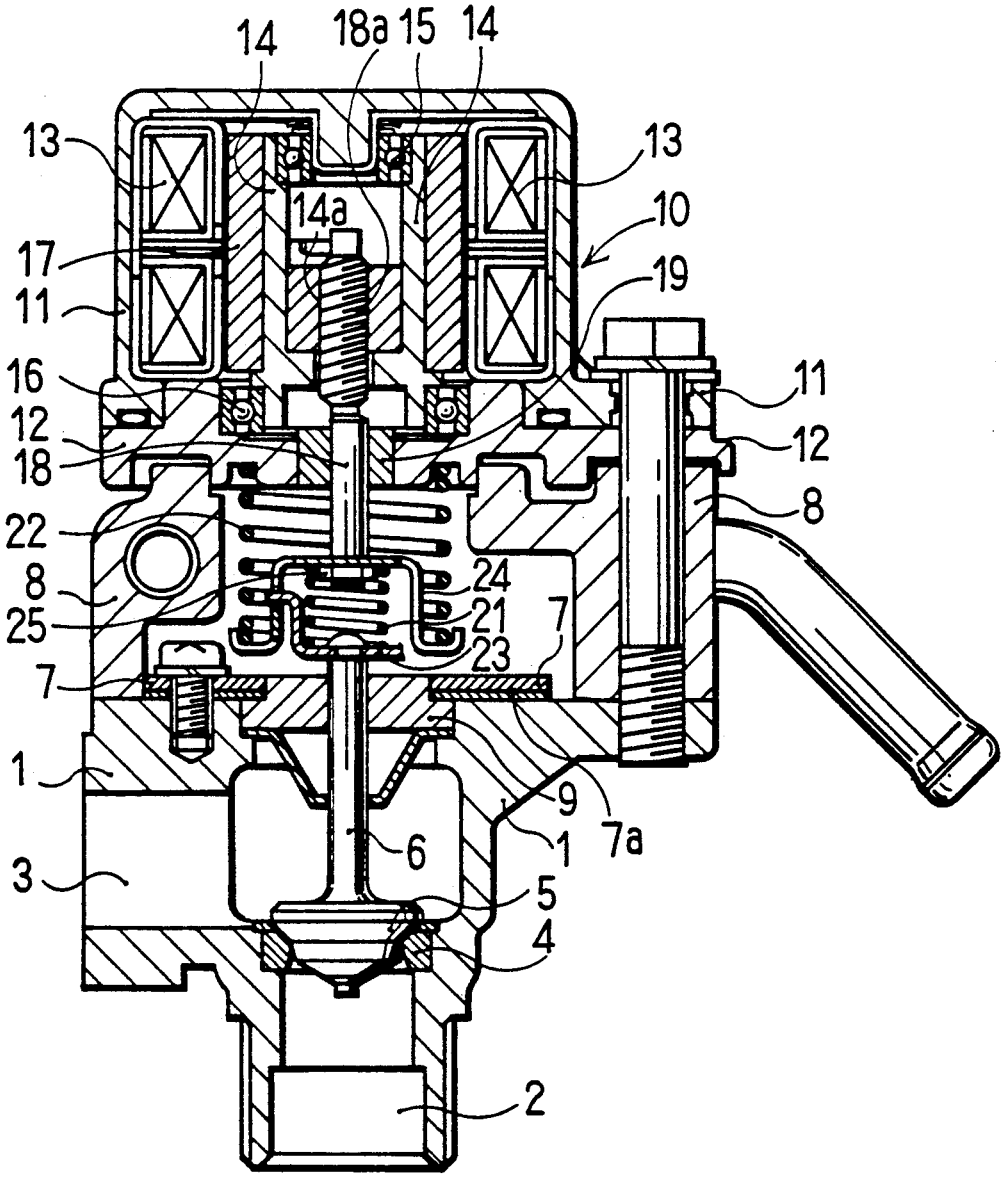
FIG. 1 is a longitudinal section showing a flow control valve according to an embodiment of the present invention.

FIG. 1 is a section showing an exhaust gas recirculation valve system of a drive-type step motor according to the present invention. Reference numeral 1 designates a valve housing providing a valve body. This valve housing 1 is formed with an inlet port 2 at its lower portion and an outlet port 3 above and at the left hand side of the inlet port 2 as shown in FIG. 1. The valve housing 1 has a passage equipped with a valve seat 4. Moreover, a valve member 5 is attached to the leading end of a valve stem 6 and can be seated on the valve seat 4. The valve stem 6 extends upwardly through valve bearing 9 which is fitted in the upper end of the valve housing 1. The valve bearing 9 is fixed by means of a fixing plate 7 in the valve housing 1 through a gasket *7a*.

A step motor 10 is mounted downward on the upper end portion of the valve housing 1 through a joint cover 8 having a cooling water jacket.

A front cover 12 is attached to the front face or lower side of the motor housing 11 of the step motor 10 so that the motor housing 11 is fastened and fixed on the valve housing 1 through the front cover 12 and the joint cover 8. In the motor housing 11, a stator is fixed which has a bobbin wound with a four-phase magnetizing coil 13 and in which a rotor 14 is arranged.

The rotor 14 has its upper portion supported through a bearing 15 by the motor housing 11, and has its lower portion supported through a bearing 16 by the front cover 12. The rotor 14 has its outer circumference surrounded by a permanent magnet 17 and this inner circumference threaded internally, as indicated at 14*a*. The internal thread 14*a* is engaged by an external thread 18*a* of output shaft 18, which is arranged in rotor 14. This output shaft 18 is vertically slidably supported by a bearing 19 which is fitted in the front cover 12, and has its leading end projected downward from the front cover 12, i.e., into the joint cover 8.

To the leading end of the output shaft 18 in the joint cover 8, a retainer 24 is fixed by a nut 25 and is formed into a cup shape having three legs. The legs of retainer 24 have their leading ends bent outwardly. Between the retainer 24 and the front cover 12, a first coil spring 22 is sandwiched for urging the output shaft 18 downwardly (in a valve closing direction) with a relatively weak spring force. In addition, the individual legs of the retainer 24 are projected sideways to form recessed engagement portions 24*a*, as better seen in FIGS. 2 and 3.

Figure 2:
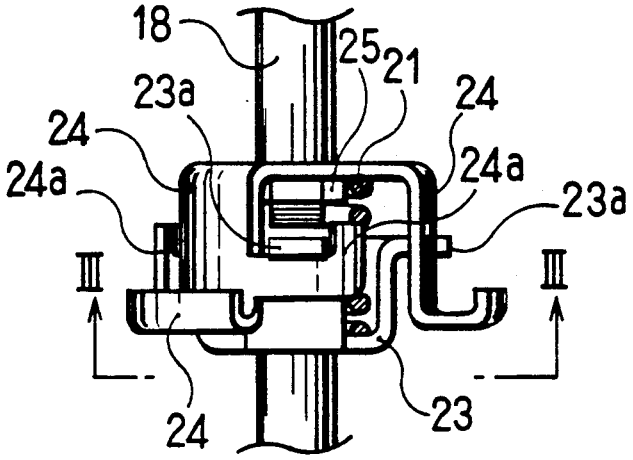
FIG. 2 is an enlarged front view showing a retainer portion.
Figure 3:
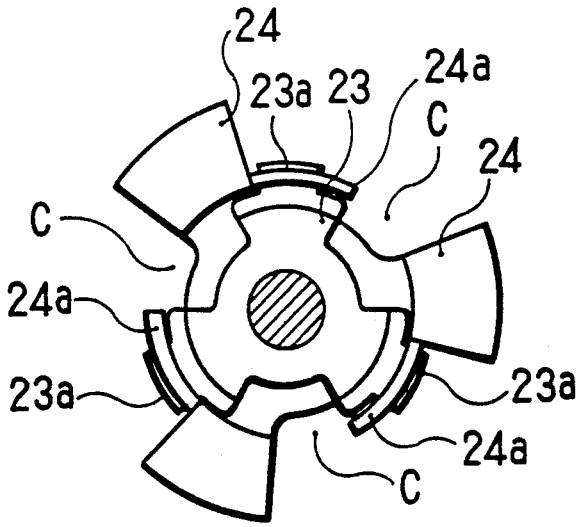
FIG. 3 is a section taken along line III—III of FIG. 2.

As shown in FIGS. 2 and 3, a cup-shaped small retainer 23 having three legs is arranged in the retainer 24, the legs being bent outwardly such that their leading ends 23*a* engage with the recesses of the individual engagement portions 24*a* of retainer 24. A valve closing (compression) coil spring 21 is sandwiched under compression between the retainer 24 and the small retainer 23. Since the leading ends 23*a* of the individual legs of the small retainer 23 are in engagement with the recesses of the individual engagement portions 24*a* of the retainer 24, the retainer 24 and the small retainer 23 are allowed to move within a considerable range to compress the coil spring 21. As a result, in the case where the valve member 5 is seated on the valve seat 4 and the output shaft 18 is moved downwardly, the retainer 24 is slightly moved relative to the small retainer 23 while compressing the valve closing coil spring 21. At this time, the inner edges of the engagement portions 24*a* provide guides for the individual legs of the small retainer 23.

In the case where the small retainer 23 is to be assembled with the retainer 24 at the time of manufacture the leading ends 23*a* of the legs of the small retainer 23 are easily forced into engagement with the recesses of the engagement portions 24*a* of retainer 24 by the urging force of the valve closing coil spring 21. Assembly is easily performed if a) the individual legs of the small retainer 23 are pushed inwardly while compressing the valve closing coil spring 21 through a clearance C, which is formed between the individual legs and the engagement portions 24*a* of the retainer 24, and b) if the small retainer 23 is turned counter-clockwise and released.

The aforementioned valve stem 6 is welded at its upper end to the lower side of small retainer 23. The valve closing coil spring 21 is set to have a smaller winding diameter than that of the aforementioned first coil spring 22 but to have a stronger spring constant than that of the first coil spring 22. When the step motor 10 causes the output shaft 18 to project downwardly, the valve member 5 is held in a closed position by the ample spring force of coil spring 21.

FIG. 1 shows the state in which the valve member is closed. In this state, the valve member 5 is closed without fail by the stronger spring force of the valve closing coil spring 21 in addition to that of the first coil spring 22. In the open state of the valve member 5, moreover, the output shaft 18 of the step motor is always urged downwardly by the first coil spring 22 so that it is prevented from vibrating and having its threaded portion chattering or backlashing.

For opening the valve, on the other hand, the step motor 10 acts to raise the output shaft 18 against the spring force of the first coil spring 22. However, since the spring force of the first coil spring 22 is set weaker than that of the valve closing coil spring 21, the step motor 10 is not required to have a high torque.

The exhaust gas recirculation valve thus constructed is used wherein the inlet port 2 is connected with the exhaust system of an internal combustion engine, the outlet port 3 is connected with the intake system of the same, and the step motor 10 is connected with the drive circuit. The drive circuit is controlled in accordance with the running condition of the internal combustion engine by a controller for completely controlling the internal combustion engine, so that it precisely drives and controls the forward and backward rotating speeds of the step motor.

In a case where the valve is to be opened from the closed state of FIG. 1, the step motor 10 rotates the rotor 14 in a direction to raise the output shaft 18. Such that the retainer 24 rises while compressing first coil spring 22. The step motor 10 can open the valve with a low torque partly because the spring force of the first coil spring 22 is weak, and partly because the spring force of the valve closing coil spring 21 acts in an upward direction at the beginning of the valve opening.

When the output shaft 18 further rises, it is only required to overcome the urging force of the first coil spring 22. Since the spring force of the coil spring 22 is made weaker, the step motor 10 acts with a low torque to move the valve member 5 in the opening direction. Since the torque needed to be applied to the output shaft 18 is lower than that of the prior art, the frictional resistances to be overcome between the internal thread of the rotor 14 and the external thread of the shaft 18 are less, so that the threaded portions are less worn.

In the case where the valve is to be closed, on the other hand, the step motor 10 rotates the rotor 14 in a direction so that the output shaft 18 is projected and moved downwardly. Since, at this time, the spring force of the first coil spring 22 acts in a direction to move the shaft downwardly, the step motor 10 can drive with a very low torque. When the valve member 5 abuts the valve seat 4, the output shaft 18 moves downwardly while compressing the valve closing coil spring 21, until the step motor 10 stops. In this state, since the valve member 5 is urged and closed by the valve closing coil spring 21 having a stronger spring force, the valve can be closed in a well sealed state. Though the embodiment thus far described employs a step motor, a DC motor or an ultrasonic motor or the like can also be used.

As has been described hereinbefore, the flow control valve according to the present invention is constructed such that the retainer is attached to the leading end of the output shaft, such that the coil spring for urging the output shaft forward is sandwiched between the retainer and the motor. The small retainer is attached to the leading end of the valve stem, such that the large retainer and the small retainer are connected through the valve closing coil spring for urging the valve stem in the valve closing direction. The spring force of the first coil spring is set weaker than that of the valve closing coil spring.

At valve opening time, the motor moves its output shaft against the spring force of the first coil spring which is sandwiched between the retainer and the front of the motor. However, since the spring force of the first coil spring is set at the weaker level, the motor can accomplish the valve opening action with a low torque. Moreover, the spring force of the valve closing coil spring acts to retract the shaft at the beginning of the valve opening action to help lower the necessary torque for the motor to open the valve. As a result, it is possible to use a small-sized motor which has a lower torque and a lower power consumption than the motors controlling flow control valves in the prior art. The threaded portions of the rotor are also subjected to a lower frictional resistance so that these portions are less worn. At valve closing time, the valve member is urged and closed by the valve closing coil spring having the stronger spring force so that the valve can be closed in an excellent sealing state.

While the preferred embodiments of the present invention have been shown and described, it is to be understood that these disclosures are for the purpose of instruction only, and that various changes and modifications may be made without departing from the scope of the invention as set forth in the appended claims.

What is claimed is:

1. A flow control valve comprising:

(a) a valve housing having inlet and outlet ports and a valve seat in a passage therebetween;

(b) a lift type valve member for seating on said valve seat in said valve housing and having a valve stem;

(c) a joint cover fixed on said valve housing;

(d) a linear motor fixed on said joint cover and including a projecting output shaft having an external thread and a rotor fitted in said motor, said rotor having an internal thread engaging with the external thread of said output shaft so that said output shaft is axially moved by the rotation of said rotor;

(e) a first retainer attached to the leading end of said output shaft projecting into said joint cover; and a second retainer fixed to the leading end of said valve stem and connected to said first retainer such that it can move within a predetermined range in the axial direction of said valve stem;

(f) a first coil spring sandwiched between said first retainer and a front cover of said motor for urging said output shaft in a projecting direction; and (g) a valve closing coil spring arranged between said first retainer and said second retainer for urging said valve stem in a valve closing direction, said first coil spring having a spring force set weaker than that of said valve closing coil spring.

2. A flow control valve according to claim 1, wherein said first and second retainers are cup-shaped and have three legs bent outwardly at their leading ends, and wherein said retainers have individual legs formed at their respective sides with recessed engagement portions, and wherein the individual legs of said second retainer have leading ends engaging with the engagement portions of said first retainer such that said individual legs of said second retainer are within the recesses of said engagement portions of said first retainer and are held movably within a predetermined range by the urging force of said valve closing coil spring.

3. The flow control valve of claim 1, further comprising a valve bearing fixed in an upper end of said valve housing.

4. The flow control valve of claim 3, wherein said valve stem extends through said valve bearing, and wherein said valve bearing is fixed through a gasket by means of a fixing plate.

5. The flow control valve of claim 1, wherein said joint cover comprises a cooling water jacket.

6. The flow control valve of claim 1, further comprising a stator fixed within a motor housing for housing said linear motor.

7. The flow control valve of claim 6, wherein said stator comprises a bobbin wound with a four-phase magnetizing coil surrounding said rotor.

8. The flow control valve of claim 1, further comprising a permanent magnet surrounding the outer circumference of said rotor.

9. The flow control valve of claim 2, wherein the valve stem is welded at its upper end to said second retainer.

10. The flow control valve of claim 1, wherein said valve closing coil spring has a smaller winding diameter than said first coil spring.

11. The flow control valve of claim 1, wherein said first coil spring and said valve closing coil spring are coaxial.

12. The flow control valve of claim 1, wherein said inlet port is connected to an exhaust system for an internal combustion engine, and said outlet port is connected to an intake system of said internal combustion engine.

13. The flow control valve of claim 12, further comprising a drive circuit connected to said motor for controlling said motor in accordance with running conditions of said internal combustion engine.

14. An engine air flow system, comprising:

an internal combustion engine;

an intake system for feeding air to said internal combustion engine;

an exhaust system for feeding exhaust from said internal combustion engine;

a valve housing having inlet and outlet ports, said inlet port being in fluid communication with said exhaust system, and said outlet port being in fluid communication with said intake system;

a valve seat disposed within a passage between said inlet and outlet ports;

a lift type valve member for seating on said valve seat in said valve housing and having a valve stem;

a joint cover fixed on said valve housing;

a linear motor fixed on said joint cover and including a projecting output shaft having an external thread and a rotor fitted in said motor, said rotor having an internal thread engaging with the external thread of said output shaft so that said output shaft is axially moved by the rotation of said rotor;

a first retainer attached to the leading end of said output shaft projecting into said joint cover; and a second retainer fixed to the leading end of said valve stem and connected to said first retainer such that it can move within a predetermined range in the axial direction of said valve stem;

a first coil spring sandwiched between said first retainer and a front cover of said motor for urging said output shaft in a projecting direction; and a valve closing coil spring arranged between said first retainer and said second retainer for urging said valve stem in a valve closing direction, said first coil spring having a spring force set weaker than that of said valve closing coil spring.

15. The engine air flow system of claim 14, wherein said first and second retainers are cup-shaped and have three legs bent outwardly at their leading ends, and wherein said retainers have individual legs formed at their respective sides with recessed engagement portions, and wherein the individual legs of said second retainer have leading ends engaging with the engagement portions of said first retainer such that said individual legs of said second retainer are within the recesses of said engagement portions of said first retainer and are held movably within a predetermined range by the urging force of said valve closing coil spring.

* * * * *